US005984836A

United States Patent [19]

Casali

[11] Patent Number: 5,984,836

[45] Date of Patent: Nov. 16, 1999

[54] MULTI-DIRECTIONAL NECK EXERCISE DEVICE

[76] Inventor: Joseph Casali, 201 E. 29th St., New York, N.Y. 10016

[21] Appl. No.: 09/057,308

[22] Filed: Apr. 8, 1998

[51] Int. Cl.[6] ..... A63B 21/12

[52] U.S. Cl. ..... 482/10; 482/129; 482/122; 602/17; 602/18

[58] Field of Search ..... 482/10, 122, 129, 482/89, 69, 904; 602/17, 32, 33, 18

[56] References Cited

U.S. PATENT DOCUMENTS

| | | | |
|---|---|---|---|
| 1,390,095 | 9/1921 | Dettinger et al. . | |
| 1,517,147 | 11/1924 | Burnett . | |
| 1,530,748 | 3/1925 | Alastalo . | |
| 1,749,488 | 3/1930 | King . | |
| 2,937,692 | 5/1960 | McMichael, Jr. . | |
| 3,051,482 | 8/1962 | Harpham . | |
| 3,425,690 | 2/1969 | Charbonnet . | |
| 3,532,340 | 10/1970 | Nardiello . | |
| 4,111,415 | 9/1978 | Reitano . | |
| 4,219,193 | 8/1980 | Newman | 272/94 |
| 4,537,393 | 8/1985 | Kusch . | |
| 4,645,198 | 2/1987 | Levenston . | |
| 4,832,333 | 5/1989 | Lockett . | |
| 5,135,445 | 8/1992 | Christensen et al. . | |
| 5,209,482 | 5/1993 | Hopfer . | |
| 5,221,241 | 6/1993 | Bare, II . | |
| 5,336,139 | 8/1994 | Miller . | |
| 5,507,707 | 4/1996 | Miller . | |
| 5,509,869 | 4/1996 | Miller . | |
| 5,626,546 | 5/1997 | Little . | |

FOREIGN PATENT DOCUMENTS

| | | |
|---|---|---|
| 1509073 | 9/1989 | U.S.S.R. . |

*Primary Examiner*—Jerome W. Donnelly
*Assistant Examiner*—Tam Nguyen
*Attorney, Agent, or Firm*—Nelfgott & Karas, P.C.

[57] ABSTRACT

An exercise device that includes a support member disposed in a predetermined position by a mounting unit. A resistive ring secured to the support member, wherein the resistive ring includes a first ring and a plurality of resistive members connected to the first ring. A head harness connected to the other ends of the plurality of resistive members. The resistive ring further includes a second ring for attaching the head harness to the resistive members.

20 Claims, 3 Drawing Sheets

MULTI-DIRECTIONAL NECK EXERCISE DEVICE

BACKGROUND OF THE INVENTION

1. Field of the Invention

The present invention relates in general to exercise devices and, in particular, to an exercise device that enables a user to exercise the cervical or neck muscles unidirectionally as well as in a multi-directional manner.

2. Description of Prior Developments

The cervical or neck muscles often require exercising for a number of reasons. One reason is to strengthen the neck muscles, which would be useful in such sports as football, boxing, wrestling or even body building. Another reason is to rehabilitate the neck muscles in order to overcome an injury or chronic condition. An example of such an injury could be a neck or head trauma caused by a car accident or sports injury. Rehabilitating the neck muscles is also useful in treating neurological damage such as paralysis or stroke.

In strengthening or rehabilitating the neck muscles, moving the neck in a multi-directional manner is desirable since it enables the neck muscles to be exercised simultaneously. This enables the neck muscles to be strengthened more effectively in a shorter period of time. An example of a multi-directional movement is when the neck achieves circumduction. Achieving circumduction is when the neck rotates in a 360 degree range of motion. Such a movement enables a number of the neck muscles to be exercised simultaneously.

In the case of rehabilitating neck injuries or conditions, multi-directional movements could drastically reduce the recovery time of the patient. Since moving in a multi-directional manner is a more natural neck movement, the coordination of the neck muscles also could be improved.

The current neck exercising or rehabilitation equipment does not enable a user's neck to be exercised in a multi-directional manner or in a full range of motion. This is because the current neck exercising or rehabilitation equipment only provides for unidirectional vertical, horizontal or rotational movement. Therefore, the current equipment cannot strengthen the neck muscles as effectively when multi-directional movements are utilized.

Since the current neck equipment only allows for unidirectional movement, often in order to exercise different neck muscles either the user or the device has to be repositioned. Such constant repositioning can be difficult for a user who has suffered a serious injury or has a debilitating condition. Further, the current neck equipment is often not adjustable which can make it difficult to use for people who are either below or above average size.

Examples of prior art neck exercise devices are disclosed in U.S. Pat. No. 4,537,393 to Kusch, U.S. Pat. No. 4,645,198 to Levenston or U.S. Pat. No. 5,135,445 to Christensen. However, the devices disclosed in these patents have some of the same disadvantages, as described above. For example, the device disclosed in Kusch is not configured to adjust to the size and needs of the user. Further, Kush, Levenston and Christensen do not disclose devices that enable a user to exercise the cervical or neck muscles in a multi-directional manner.

In view of the above, a need therefore exists for an exercise device that enables a user to exercise the cervical or neck muscles in a unidirectional, as well as a multi-directional manner. A further need exists for a neck exercise device that is adjustable to the various needs and size of the user.

SUMMARY OF THE INVENTION

The present invention has been developed to fulfill the needs noted above and therefore has as an object the provision of an exercise device that enables a user to exercise the cervical or neck muscles in a unidirectional as well as a multi-directional manner.

Another object of the invention is to provide an exercise device that enables a user to exercise the cervical or neck muscles in a full range of motion.

Another object of the invention is to provide an exercise device that is adjustable to the particular size and needs of the user.

Another object of the invention is to provide an exercise device that enables all of the neck muscles to be exercised without requiring re-positioning of either the user or device.

Still another object of the invention is to provide an exercise device that is both light weight and compact in size, which makes the device both portable and readily adaptable to home use.

These and other objects are met in accordance with the present invention which is directed to an exercise device including a support member disposed in a predetermined position by a mounting unit. A resistive ring is secured to the support member, wherein the resistive ring includes a first ring and a plurality of resistive members connected to the first ring. A head harness is connected to the plurality of resistive members. The exercise device further including a second ring for attaching the head harness to the resistive members.

The head harness includes a semi-flexible wrap and a harness ring disposed around and attached to the wrap. The head harness also includes a stabilizer attached to the harness ring for contacting the head of a user in order to prevent the head harness from being twisted or rotated when being used.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the drawings.

In the various figures of the drawings, like reference characters designate like parts.

DETAILED DESCRIPTION OF THE PREFERRED EMBODIMENTS

Figure 1:
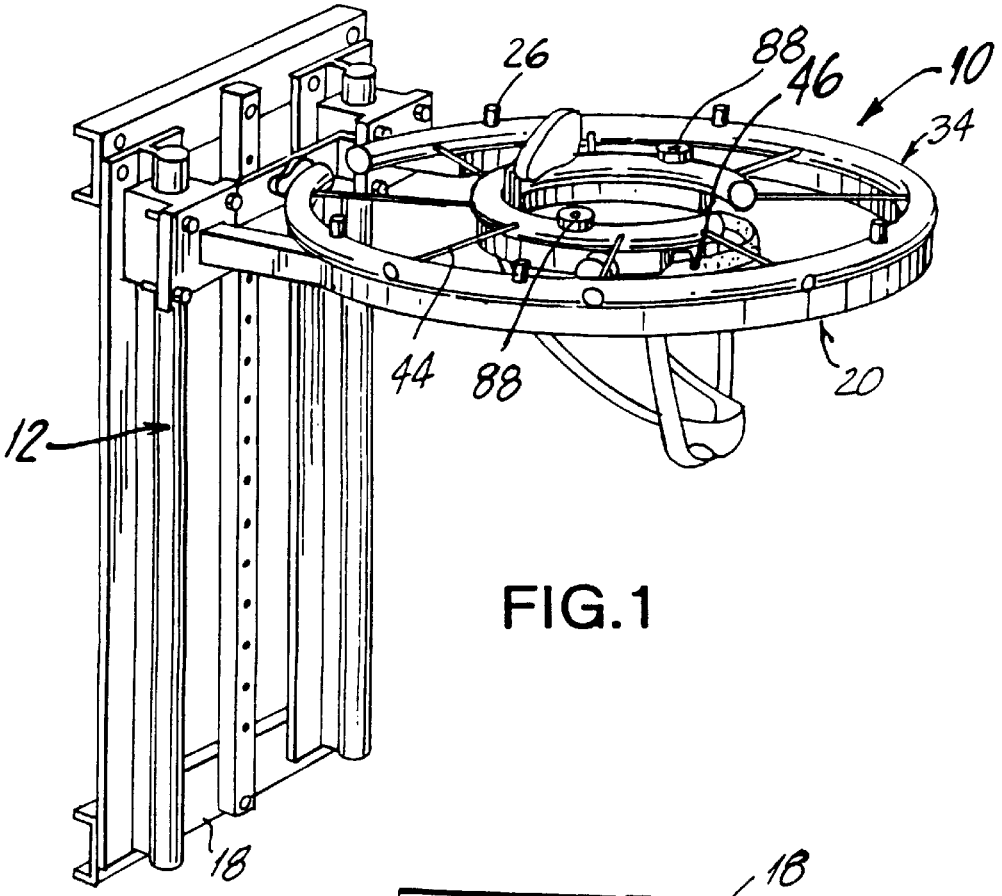
FIG. 1 is a side perspective view of the neck exercise device according to the present invention.

The present invention will now be described in conjunction with the drawings beginning with FIG. 1, which depicts a multi-directional neck exercise device 10 constructed according to the present invention.

The multi-directional neck exercise device 10 according to the present invention has four main parts including a mounting unit 12, a support member 20, a resistive ring 34 and a head harness 46. As can be seen, the support member 20 is attached to the mounting unit 12 and supports the resistive ring 34 in a predetermined position. The mounting unit 12 is vertically adjustable which enables the support member 20 to be adjusted to the height of the user.

The resistive ring 34 is secured to and supported by the top surface of the support member 20, as shown. The resistive ring 34 is the part of the device that actually provides the resistance for exercising the neck of the user. Connected to the resistive ring 34 is the head harness 46, which transfers the resistance provided by the resistive ring 34 to the user. Each of the above mentioned parts of the device will be described in more detail below.

The multi-directional neck exercise device 10 according to the present invention is configured to allow a user to exercise the neck muscles individually or simultaneously for a full range of motion. This is accomplished by the particular design of the resistive ring 34, which enables the neck of the user to move in an unidirectional as well as a multi-directional manner.

As described previously, moving in a multi-directional manner is desirable since it enables the neck muscles to be more effectively exercised in a shorter period of time. Thus, rehabilitation time for the various neck injuries or conditions can be reduced. Further, moving in a multi-directional manner also has the potential for improving the coordination of the neck muscles.

Figure 2:
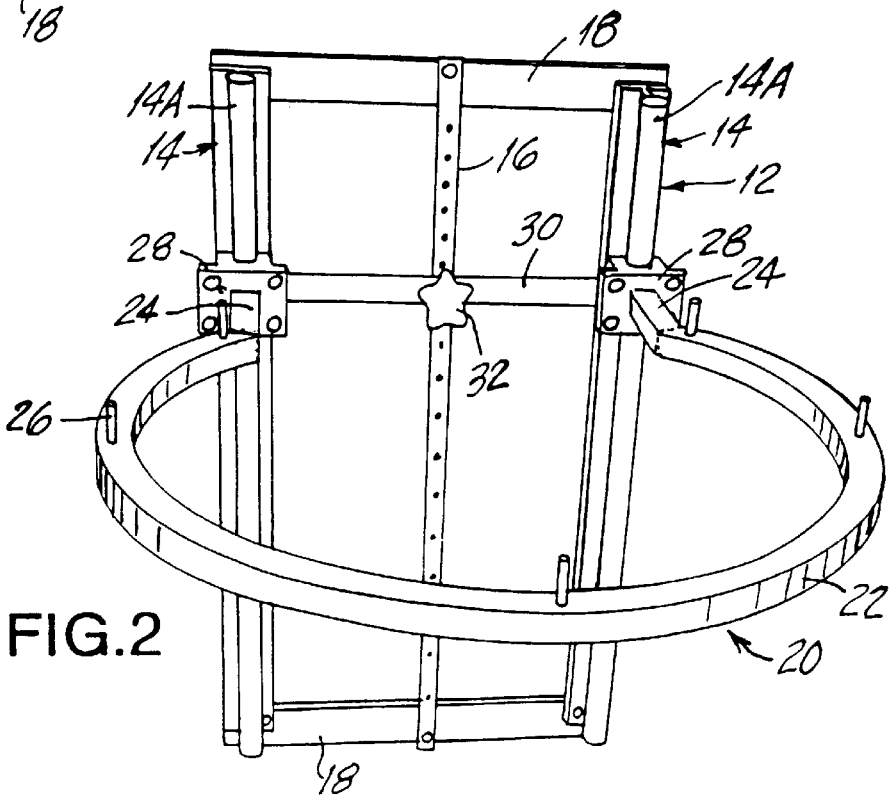
FIG. 2 is a top perspective view of the mounting unit and the support member according to the present invention.

A more detailed view of the mounting unit 12 and support member 20 according to the present invention is shown in FIG. 2. In this particular embodiment, the wall mounting unit 12 is configured to be secured to a wall. The wall mounting unit 12 provides the device 10 with the stability required to effectively exercise the neck muscles of a user.

The wall mounting unit 12 includes two cross beams 18, two vertical slide members 14 and a vertical position member 16. The cross beams 18 extend horizontally and are attached to either a wall or door surface. Connected between each of the vertically aligned ends of the cross beams 18 is one of the vertical slide members 14. The vertical slide members 14 each include a rod 14*a* for sliding the support member 20 onto. This enables the device according to the present invention to adjust to the height of the user since the support member 20 can be moved to various vertical positions by being slid along the rods 14*a*.

Connected to the center of each of the cross beams 18 is the vertical position member 16. The vertical position member 16 includes a plurality of holes disposed along its length. Each of the holes corresponds to the different vertical positions that the support member 20 can be moved between.

According to the present invention, it is preferred that the wall mounting unit 12 is positioned perpendicular to the floor and approximately two feet from the floor. It is also preferred that the cross beams 18 and vertical members 14,16 are fabricated from stainless steel. It is further preferred that the rods 14*a* have a length of two feet and a diameter of one inch, and are spaced fifteen inches apart.

As previously described, the support member 20 supports the resistive ring. As can be seen from FIG. 2, the support member 20 includes a C-ring section 22 and two straight sections 24. The C-ring section 22 is the part of the support member 20 that actually supports the resistive ring. Since the C-ring section 22 is configured similarly in size as well as in shape to the resistive ring, it can contact a majority of the under surface of the resistive ring. This is desirable since it will prevent the resistive ring from being vertically rotated while being used.

Extending from an upper surface of the C-ring section 22 is a plurality of pins 26. The plurality of pins 26 provide horizontal stability by preventing the resistive ring from moving horizontally during use. Even though in this embodiment pins are utilized, the present invention contemplates other fasteners such as clips, snaps, buckles, VELCRO, etc. are contemplated.

As described above, the support member 20 also includes a straight section 24 extending from each end of the C-ring section 22. The straight sections 24 enable the support member 20 to be positioned at a comfortable distance from the wall unit 12.

Attached to the rear end of each of the straight sections 24 are pillow blocks 28, which attach the support member 20 to the wall mounting unit 12. The pillow blocks 28 include apertures vertically disposed, which slide on and off from the rods 14*a* of the slide members 14. This enables the support member 20 to be readily attached and detached from the mounting unit 12, which contributes to the portability and compactness of the present invention.

The pillow blocks 28 also enable the support member 20 to slide along the rods 14*a* to the various vertical positions of the mounting unit 12, described previously. Further, the pillow blocks 28 include ball bearings for reducing the friction between these devices and the rods 14*a*. An example of a suitable pillow block for the present invention is a Super Pillow Block, Part No. 1757-716-00, Star Linear.

Connected to each of the pillow blocks 28 is a cross bar 30, which further braces the support member 20. Disposed in the cross bar 30 is a locking mechanism 32, which is utilized to lock the support member 20 in the various positions of mounting unit 12. The locking mechanism 32 includes a pin (not shown), which is inserted in the holes of the vertical position member 16 in order to lock the support member 20 in a particular vertical position.

According to the present invention, it is preferred that the C-ring section 22 and straight sections 24 are fabricated from one inch aluminum tubing. It also preferred that the C-ring section 22 has a twenty-three inch diameter and that the straight sections 24 extend outward four inches from the ends of the C-ring section 22 forming a 320 degree rotation. It is further preferred that the C-ring section 22 includes five pins 26 spaced at equal distances from each other and having a height of one and quarter inches.

Figure 3:
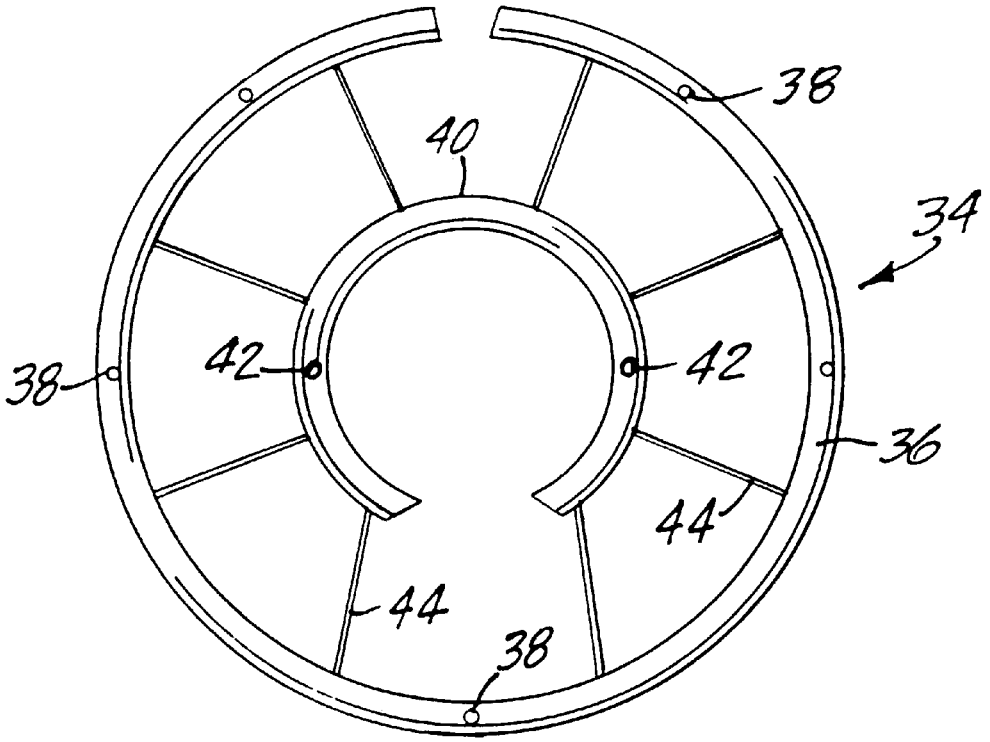
FIG. 3 is a top view of the resistive ring according to the present invention.

A more detailed view of resistive ring 34 according to the present invention is shown in FIG. 3. As previously described, the resistive ring 34 is the part of the device that provides the resistance for exercising the neck of the user. The resistive ring 34 includes a plurality of resistive members 44 connected between an outer ring 36 and an inner ring 40. When no force is applied to the inner ring 40, the resistive members 44 holds the inner ring in a concentric position with respect to the outer ring 36, as shown. When a force is applied to the inner ring 40 and the outer ring 36 is secured, the resistive members 44 provide a counter force or resistance opposing the force applied to the inner ring 40.

According to the present invention, the resistive members 44 are embodied by springs, latex bands, counter weights or other resistance providing devices. Further, in order to effectively transfer a majority of the force or resistance produced by the resistive members 44, the inner and outer rings 36,40 are rigid.

The outer ring 36 should be approximately of the same diameter as the C-ring section of the support member in order for the resistive ring 34 to be properly supported. Further, the outer ring 36 includes a plurality of apertures 38 that are aligned with the pins on the support member. This enables the pins of the support member to extend into the apertures 38 when the resistive ring 34 is placed on the support member.

As can be seen from FIG. 1, the resistive ring 34 being placed on the support member 20 enables the pins 26 to extend upward through the apertures. As previously described, this configuration stabilizes the resistive ring 34 by preventing it from being horizontally displaced when the device is being used.

Further, the above described pin 26 and aperture configuration also enables the resistive ring 34 to be easily taken on and off the support member 20. Such a feature is significant since the present invention includes utilizing a plurality of interchangeable resistive rings each providing a different level of resistance. Each of the interchangeable resistive rings will incorporate resistive members having different levels of resistance. In order to distinguish the interchangeable resistive rings, a color coding scheme can be utilized where the least resistance level can be designated by a color such as yellow and the greatest resistance level is designated by another color such as gray.

Referring back to FIG. 3, the inner ring 40 also includes apertures 42, which are utilized to attach it to the head harness. The inner ring 40 being attached to the head harness ensures that the resistance produced by the restive ring 34 is evenly distributed to the user. As can be seen, the inner ring 40 is of a C-ring configuration, which has been found to be more comfortable for the user. Since the open portion of the inner ring 40 is intended to be placed over the face of the user, the vision of the user is not blocked nor does the user feel enclosed.

According to the present invention, it is preferred that the resistive members 44 be embodied by eight equally spaced five inch latex bands. It also preferred that the inner and outer rings 36, 40 have a thickness of one inch and are made from a plastic material such as polyvinylchloride (PVC). It is further preferred that the outer ring 36 has a diameter of approximately twenty-three inches and the inner ring 40 has a diameter of approximately eleven and one-half inches.

Figure 4:
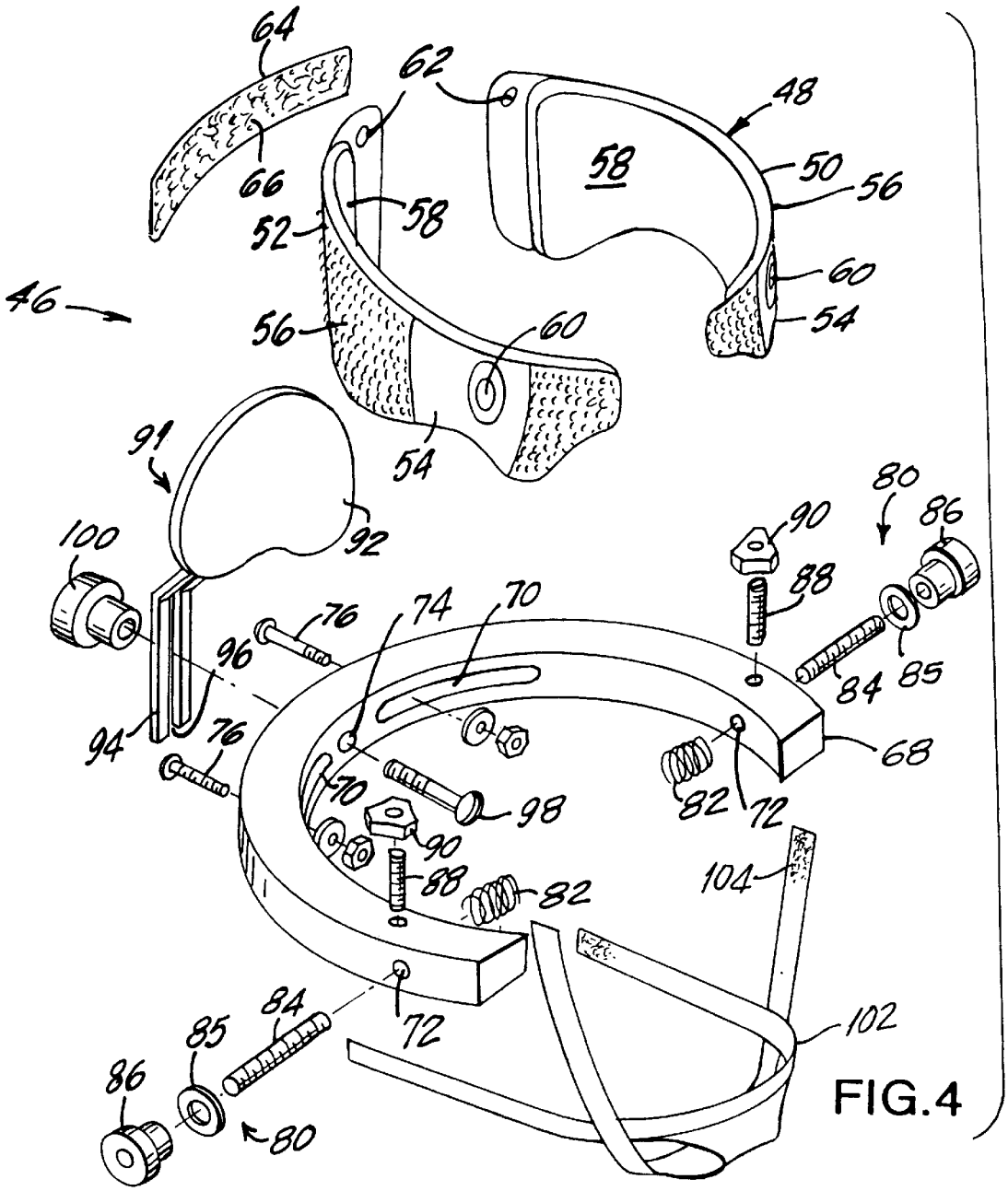
FIG. 4 is an exploded view of the head harness according to the present invention.

An exploded view of the head harness 46 according to the present invention is shown in FIG. 4. The head harness 46 includes a semi-flexible wrap 48 which attaches to the head of the user. The wrap 48 includes two side pieces 50,52 which are secured together by a cross-strap 64. According to the present invention, it is preferred that VELCRO fasteners secure the wrap 48 together. Disposed on the outer surfaces of the side pieces 50,52 is male VELCRO 56, while disposed on the inner surface of the cross-strap 64 is female VELCRO 66.

The above described configuration of the wrap 48 enables it to be adjustable to fit the heads of a majority of the population. Since the cross-strap 64 includes the female VELCRO 66 for the entire length, the side pieces 50,52 are capable of being either secured close together in order to fit smaller heads or secured farther apart to fit larger heads.

Each of the side pieces 50,52 also include a cushioning pad 58 disposed on the inner surface of the side pieces 50,52, which provides additional comfort for the user. The cushioning pads 58 are preferably fabricated from soft foam material.

Each of the side pieces 50,52 further include an ear cut out 54, as shown. When the wrap 48 is secured to the head of a user, the cutouts 54 are disposed around the ears of the user ensuring that the head harness 46 is positioned on the upper portion of the head, which has found to be a more comfortable and effective position. It is also preferred that the wrap 48 is fabricated from a semi-flexible material such as various plastics.

The head harness 46 further includes a harness ring 68 which extends around the rear of the wrap 48. As can be seen, the harness ring 68 attaches to each of the side pieces 50,52 in two places including the rear and front. The harness ring 68 is attached to the rear ends of the side pieces 50,52 by two bolts 76. When assembled, the bolts 76 extend through holes 62 of the side pieces 50,52 and slots 70 of the harness ring 68. The slots 70 enable the position of the side pieces 50,52 to be adjusted horizontially to fit the head of the user, as described previously.

The harness ring 68 attaches to the front of the side pieces 50,52 by two spring loaded pin assemblies 80. Each of the assemblies 80 include a spring 82, a threaded pin 84, a washer 85 and a knob 86, as shown. When assembled, each of the pins 84 extend through holes 72 of the harness ring 68 and are screwed into holes 60 of the side pieces 50,52 in order to attach the harness ring 68 to the side pieces 50,52. The knobs 86 attach to the pins 84 which are utilized to rotate the pins 84 relative to the harness ring 68. The pins 84 being rotated either in or out respectively tightens or loosens the wrap 48 on the head of the user. This enables the head harness 46 to be further adjusted to fit a variety of head sizes.

The harness ring 68 performs a number of functions including attaching the head harness 46 to the resistive ring. The harness ring 68 further stabilizes the wrap 48 when the head harness is placed on the head of the user. Since the harness ring 68 is attached to the rear ends of the side pieces 50,52, the wrap 48 is prevented from being vertically rotated when being used.

The harness ring 68 is also of a C-ring configuration, which as previously described is a more comfortable configuration for the user. The harness ring 68 also includes two threaded pins 88 that extend upward from a top surface, which are aligned with the apertures in the inner ring of the resistive ring. The pins 88 along with fasteners 90 are utilized in order to secure the head harness 46 to the resistive ring. As can be seen from FIG. 1, the pins 88 extend upward through the apparatus of the inner ring. Such a configuration is desirable since it makes it easy to attach and detach the head harness 46 to the device 10.

Referring back to FIG. 4, it is preferred that the harness ring 68 is fabricated from aluminum square tubing having a thickness of one inch and, a diameter of eleven and one-half inches. It is further preferred that the pins 88 have a length of one and one-quarter inches.

A stabilizer 91 also attaches to the harness ring 68, as shown. The stabilizer 91 includes a stabilizing pad 92 which is attached to a bracket 94. The pad 92 is utilized to contact an upper portion of a user's head when the head harness 46 is being used. This stabilizes the head harness 46 by preventing it from being twisted or rotated vertically.

The bracket 94 attaches the stabilizer 91 to the harness ring 68 and includes a vertical slot 96. When assembled, a bolt 98 extends through both a hole 74 of the harness ring 68 and the slot 96. Another knob 100 which includes an inner thread secures the stabilizer 90 onto the harness ring 68 when placed on the bolt 98. When the knob 100 is not completely tightened onto the bolt 98, the slot 96 is allowed to ride up and down the bolt which enables the pad 92 to be moved vertically up or down. This enables the stabilizer 90 to be adjustable in order to fit a variety of head lengths.

The head harness 46 also includes a chin strap 102, which ensures that the head of the user does not slip out when being used. As can be seen, the chin strip 102 includes a pair of straps on each side, which attach to both the front and rear of one of the side pieces 50,52. It is preferred that disposed at the end of each of the straps is additional female VELCRO 104, which is utilized to attach the straps to the side pieces 50,52, as described above. Since the side pieces 50,52 have male VELCRO 56 disposed all over its outer surfaces, the chin strap 102 can be attached in a variety of positions in order to fit the particular size and shape of the user's head.

Figure 5:
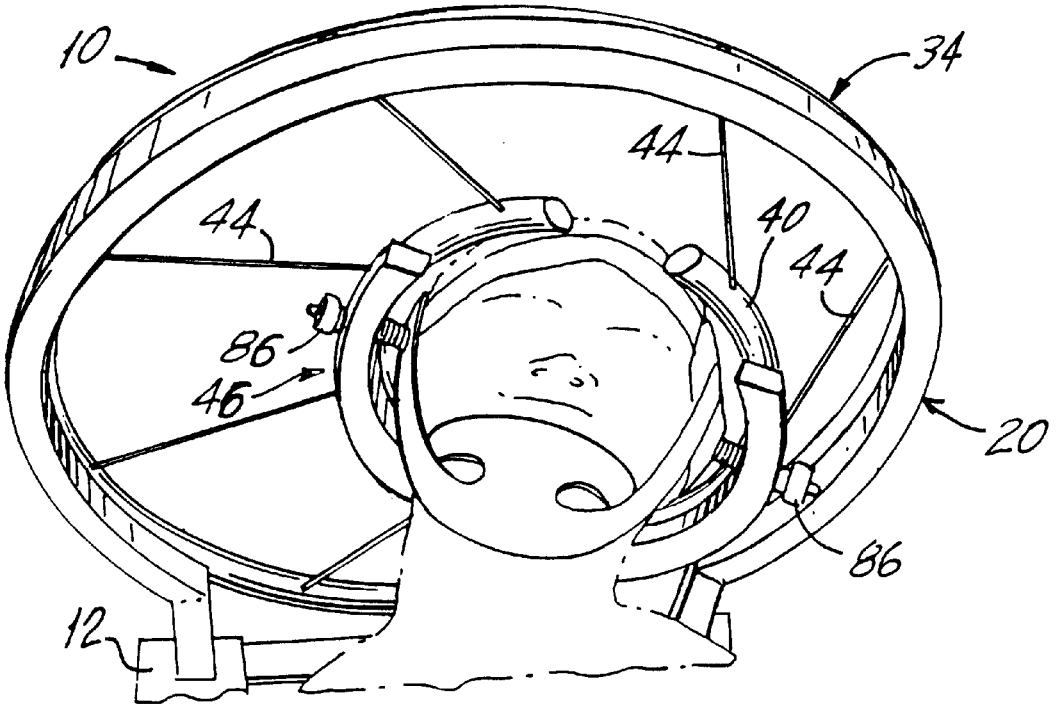
FIG. 5 illustrates the operation of the neck exercise device according to the present invention.

The operation of the circumduction neck exercise device 10 according to the present is illustrated in FIG. 5. Before the device is used, it is preferred that a professional such as a chiropractor, therapist or trainer first evaluate the exercise or the severity of the rehabilitation required based on the needs of the user. This will determine which one of the interchangeable resistive rings should be chosen for the particular user.

As previously described, the present invention includes a number of interchangeable resistive rings, which are color coded to designate the different resistance level. The use of interchangeable resistive rings provide a variable resistance for users with severe neck trauma trying to rehabilitate damaged areas or for users maximizing neck muscle strength.

The device 10 then must be set up for the user. This includes first securing the resistive ring 34 onto the support member 20, and then sliding this assembly 20,34 onto the mounting unit 12. Further, this assembly 20,34 must be vertically adjusted to the height of the user. This is accomplished by vertically sliding the assembly 20,34 on the mounting unit 12 until it is aligned with the forehead of the user. Then this assembly 20,34 is locked in place at this position.

The head harness 46 is then securely placed on the head of the user. As previously described, the harness 46 is positioned on the top portion of the head, as shown. The head harness 46 is then attached to the resistive ring 34. The knobs 86 of the head harness 46 are then rotated in order to tighten the wrap 48 around the head of the user. By virtue of this procedure, the user is securely in place and is aligned in the center of the device 10 when no resistance is applied.

In order to use the device 10, the user moves his neck in any particular direction. As can be seen, the particular resistive members 44 stretch in the direction of the motion and exert an opposing force or resistance on the inner ring 40 for the full range of motion. This opposing force is transferred to the user through the head harness 46 and thus exercises the neck muscles for the duration of the motion.

Since the configuration of the resistive ring 34 allows the user to move in a unidirectional as well as multi-directional manner, different neck muscles can be exercised simultaneously. As precisely described this is desirable, since the rehabilitation time of the user can be shortened. Further, since multi-directional movement is a more natural movement, the coordination of the neck muscles can also be potentially improved.

There has been disclosed heretofore the best embodiment of the invention presently contemplated. However, it is to be understood that various changes and modifications may be made thereto without departing from the spirit of the invention.

What is claimed is:

1. An exercise device, comprising:

a support member disposed in a predetermined position;

a resistive ring secured to said support member, wherein said resistive ring includes an outer ring, an inner ring and a plurality of resistive members connected between said outer ring and said inner ring; and a head harness connected to said inner ring.

2. The device of claim 1, wherein said inner ring is rigid.

3. The device of claim 1, wherein said inner ring has a C-ring configuration.

4. An exercise device, comprising:

a support member disposed in a predetermined position, wherein said support member includes a C-ring section and a straight section extending from each end of said C-ring section;

a resistive ring secured to said C-ring section of said support member, wherein said resistive ring includes an outer ring and a plurality of resistive members connected to said outer ring; and a head harness connected to said plurality of resistive members.

5. The device of claim 4, wherein each of said straight sections of said support member is attached to a mounting unit.

6. An exercise device, comprising:

a support member disposed in a predetermined position;

a resistive ring secured to said support member, wherein said resistive ring includes an outer ring and a plurality of resistive members connected to said outer ring; and a head harness connected to said plurality of resistive members, wherein said head harness includes a semi-flexible wrap and a harness ring attached to said wrap.

7. The device of claim 6, wherein said harness ring has a C-ring configuration.

8. An exercise device, comprising:

a wall mounting unit;

a resistive ring attached to said mounting unit, wherein said resistive ring includes a plurality of resistive members connected between an outer ring and an inner ring; and a head harness connected to said inner ring.

9. The device of claim 8, wherein said inner ring is rigid.

10. The device of claim 8, wherein said inner ring has a C-ring configuration.

11. The device of claim 8, which further includes a support member for attaching said resistive ring to said mounting unit.

12. The device of claim 8, wherein said support member includes a C-ring section and a straight section extending from each end of said C-ring section.

13. The device of claim 12, wherein each said straight section of said support member is attached to said mounting unit.

14. The device of claim 8, wherein said head harness includes a semi-flexible wrap and a harness ring attached to said wrap.

15. The device of claim 14, wherein said harness ring has a C-ring configuration.

16. The device of claim 14, wherein said wrap has a pair of ear cut-outs.

17. The device of claim 14, wherein said head harness further includes a stabilizer attached to said harness ring for contacting the head of a user in order to prevent said head harness from being twisted or rotated when being used.

18. The device of claim 1, wherein said head harness includes a semi-flexible wrap and a harness ring attached to said wrap.

19. The device of claim 6, wherein said wrap has a pair of ear cut-outs.

20. The device of claim 6, wherein said head harness further includes a stabilizer attached to said harness ring for contacting the head of a user in order to prevent said head harness from being twisted or rotated when being used.

* * * * *